US011329435B2

(12) United States Patent
Chou

(10) Patent No.: US 11,329,435 B2
(45) Date of Patent: May 10, 2022

(54) ALTERNATING CURRENT POWER INPUT SOCKET

(71) Applicant: INNOTRANS TECHNOLOGY CO., LTD., New Taipei (TW)

(72) Inventor: Tsung-Han Chou, Keelung (TW)

(73) Assignee: INNOTRANS TECHNOLOGY CO., LTD., New Taipei (TW)

( * ) Notice: Subject to any disclaimer, the term of this patent is extended or adjusted under 35 U.S.C. 154(b) by 29 days.

(21) Appl. No.: 17/003,519

(22) Filed: Aug. 26, 2020

(65) Prior Publication Data

US 2021/0075166 A1 Mar. 11, 2021

(30) Foreign Application Priority Data

Sep. 9, 2019 (TW) ..... 108132356

(51) Int. Cl.

| | |
|---|---|
| ***H01R 13/66*** | (2006.01) |
| ***H01R 4/16*** | (2006.01) |
| ***H01R 24/22*** | (2011.01) |
| ***H01R 103/00*** | (2006.01) |
| ***H01R 4/02*** | (2006.01) |

(52) U.S. Cl.

CPC ..... *H01R 13/6625* (2013.01); *H01R 4/16* (2013.01); *H01R 24/22* (2013.01); *H01R 4/023* (2013.01); *H01R 2103/00* (2013.01)

(58) Field of Classification Search

CPC .. H01R 13/6616; H01R 13/53; H01R 12/724; H01R 24/30; H01R 4/187; H02H 9/004

See application file for complete search history.

(56) References Cited

U.S. PATENT DOCUMENTS

| | | | | |
|---|---|---|---|---|
| 5,176,528 A * | 1/1993 | Fry | H01R 12/724 | 439/181 |
| 6,659,783 B2 * | 12/2003 | Copper | H01R 13/53 | 439/181 |
| 7,149,063 B2 * | 12/2006 | Bryan | H02H 9/004 | 361/13 |
| 8,215,992 B1 * | 7/2012 | Herrmann | H01R 13/6616 | 439/620.21 |

* cited by examiner

*Primary Examiner* — Jean F Duverne

(74) *Attorney, Agent, or Firm* — Muncy, Geissler, Olds & Lowe, P.C.

(57) ABSTRACT

An AC power input socket includes a casing and at least two conductive pins. The casing comprises a connection side and an output side based on performance of the AC power input socket. The casing is provided with an accommodating groove at the connection side, each of the two conductive pins includes a power connection section located in the accommodating groove, an output section extending from the power connection section and passing through the casing to be exposed on the output side, and a capacitor connecting section extending from an end of the output section. Each of the conductive pins is provided with a through hole in the output section for disposing an electric wire, and the capacitor connecting section provides a capacitor pin to be connected thereon, so that the capacitor pin and the electric wire do not need to be disposed at a same hole position.

8 Claims, 5 Drawing Sheets

ALTERNATING CURRENT POWER INPUT SOCKET

FIELD OF THE INVENTION

The invention relates to an alternating current (AC) power input socket, and more particularly to an AC power input socket that eliminates the need for an electric wire and a capacitor pin to be disposed at a same hole position of a conductive pin, thereby reducing the failure of inserting components into the hole position with certainty due to positional interference.

BACKGROUND OF THE INVENTION

In the conventional alternating current (AC) power socket for transmitting power, a plurality of connecting terminals are disposed on one side of the socket, and at least one power cord is connected to the connecting terminals to transmit power during the implement.

In addition, in order to avoid electromagnetic interference (EMI) when transmitting power, the conventional AC power socket requires at least one capacitor to be connected between the connecting terminals. Disposition of the capacitor reduces the electromagnetic waves generated by the electromagnetic induction effect after the socket and the power cord are energized, thereby reducing the influence of electromagnetic interference on external devices or other electronic components. However, the conventional socket connects the power cord and the capacitor at a same hole position of the same connecting terminal. When the processing personnel processes the socket, the power cord or the capacitor has to be assembled on the connecting terminal first before soldering, and then the remaining capacitor or power cord is assembled and soldered. However, the solder is easily transformed into a molten state during the soldering process, the power cord will easily fall off during soldering of the capacitor, thus it is required for the processing personnel to fix the power cord and the capacitor at the same time in order to continue soldering. In addition, before soldering the capacitor or the power cord, one of them is required to be wound on the connecting terminal, and then soldered. In addition to increasing the working procedure, the one being wound interferes the latter to be disposed at the same hole position, and thus it is uncertain to be able to insert the latter into the hole position.

SUMMARY OF THE INVENTION

A main object of the invention is to solve the problem that the conventional socket welds the power cord and the capacitor at a same hole, causing interference of component positions and being unable to insert the components into the hole certainty.

In order to achieve the above object, the invention provides an alternating current (AC) power input socket. The AC power input socket includes a casing and at least two conductive pins. The casing defined with a connection side and an output side opposite to the connection side based on performance of the AC power input socket. The casing is provided with an accommodating groove at the connection side for inserting a plug. The two conductive pins are a live wire terminal and a ground wire terminal respectively, and each of the conductive pins includes a power connection section disposed in the accommodating groove, an output section which is extending from the power connection section and passing through the casing to be exposed on the output side, and a capacitor connecting section which is extending from an end of the output section. Each of the conductive pins is provided with a through hole in the output section for disposing an electric wire, and the capacitor connecting section provides a capacitor pin to be connected thereon.

In one embodiment, the AC power input socket includes three conductive pins, two of the three conductive pins are live wire terminals, and one of the three conductive pins is a ground wire terminal. Each of the three conductive pins includes the power connection section, the output section and the capacitor connecting section, and each of the conductive pins is provided with the through hole for disposing the electric wire in the output section, and the capacitor connecting section provides the capacitor pin to be connected thereon.

In one embodiment, each of the conductive pins includes a first width at the output section, and each of the conductive pins includes a second width smaller than the first width at the capacitor connecting section.

In one embodiment, each of the conductive pins is formed by two connecting pins which are respectively connected to the output section, and the two connecting pins are spaced apart to form a gap therebetween for the capacitor pin to pass through, and the two connecting pins respectively bear a force to be deformed to restrict the capacitor pin in the gap.

In one embodiment, each of the conductive pins includes a first width at the output section, and a sum of widths of the two connecting pins and the gap is smaller than the first width.

In one embodiment, the gap corresponds to a center of the through hole, and a sum of widths of the two connecting pins and the gap is greater than or equal to a width of the through hole In one embodiment, a portion of each of the output sections which is close to the capacitor connecting sections is a slope.

In one embodiment, three longitudinal axis extension lines of the three conductive pins do not overlap, and two horizontal axis extension lines of two of the three conductive pins which are located on two sides overlap, and one horizontal axis extension line of one of the conductive pins which is located in a middle does not overlap with the other two horizontal axis extension lines.

In one embodiment, the AC power input socket is configured in a power supply unit.

Accordingly, compared with the conventional technique, the invention has the following features: the invention comprises the capacitor connecting section and the through hole provided on each of the conductive pins, so that the capacitor and the electric wire can be installed respectively on the capacitor connecting section and the through hole. Compared to the conventional technique, the capacitor and the electric wire of the invention do not need to be disposed at a same hole position, and therefore the situation that the component with a latter processing sequence cannot be connected on the conductive pin with certainty due to the interference of processing positions of the two components can be reduced.

DETAILED DESCRIPTION OF THE PREFERRED EMBODIMENTS

Figure 1:
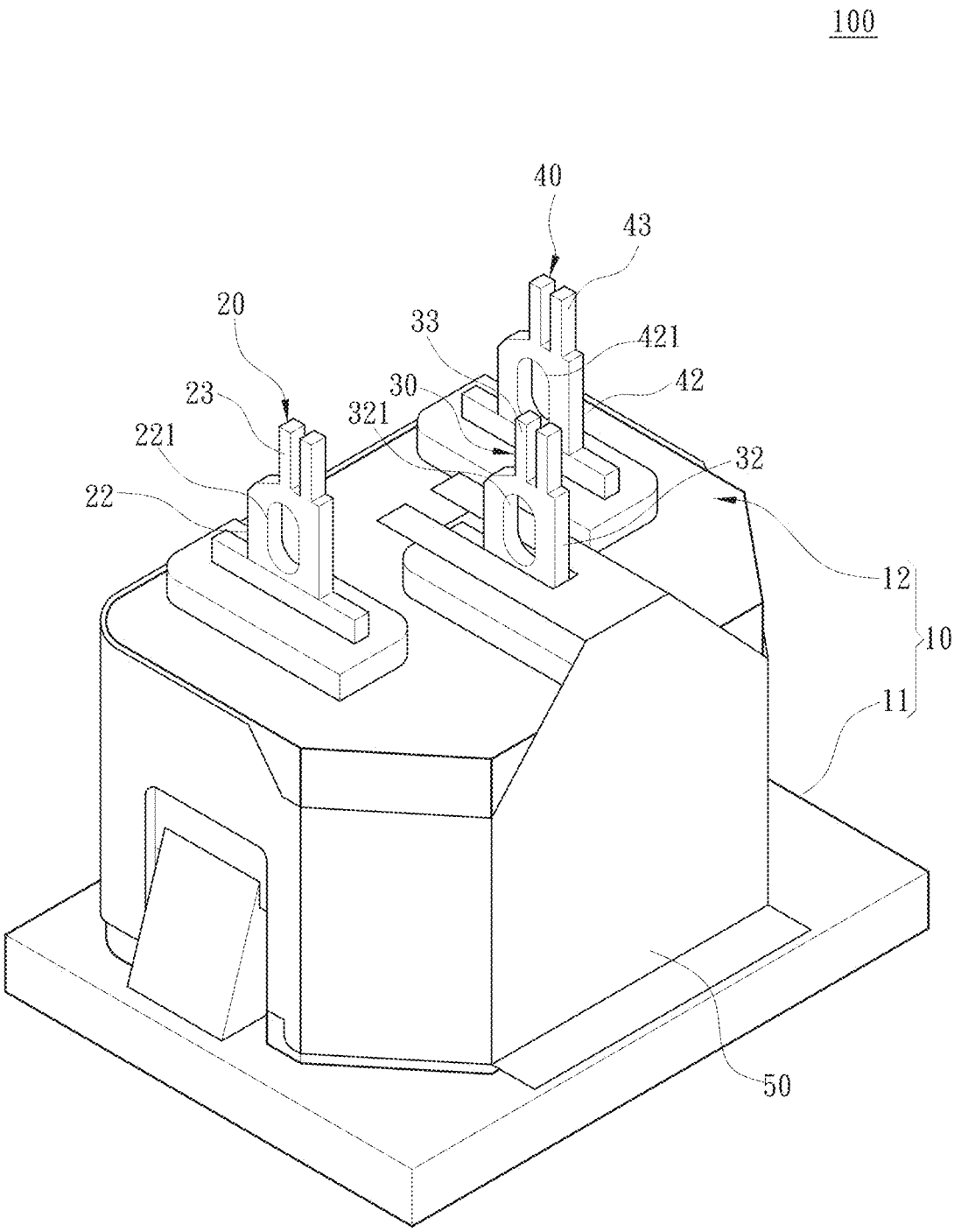
FIG. 1 is a structural perspective view according to one embodiment of the invention.

The detailed description and technical content of the invention are described below with reference to the drawings.

Please refer to FIG. 1, FIG. 2, FIG. 3 and FIG. 4, the invention provides an alternating current (AC) power input socket 100. The AC power input socket 100 can be connected to a plug (not shown in the figures) and used to transmit AC power. In one embodiment, the AC power input socket 100 is configured in a power supply unit (not shown in the figures), so that the power supply unit transmits power through the AC power input socket 100 after receiving a supply mains. The aforementioned power supply unit can be an industrial power supply unit or a power supply unit generally used by consumers.

In addition, the AC power input socket 100 includes a casing 10 and at least two conductive pins 20, 30. The casing 10 is based on performance of the AC power input socket 100 to define a connection side 11 and an output side 12 which is opposite to the connection side 11. The casing 10 is provided with an accommodating groove 111 on the connection side 11 for inserting a plug, and the accommodating groove 111 corresponds to the plug in shape. In addition, the two conductive pins 20, 30 are respectively provided on the casing 10, one of the two conductive pins 20, 30 is a live wire terminal, and the other of the two conductive pins 20, 30 is a ground wire terminal. In this specification, the conductive pin 20 is implemented as the live wire terminal, and the conductive pin 30 is implemented as the ground wire terminal. Further, each of the conductive pins 20 (30) includes a power connection section 21 (31) disposed in the accommodating groove 111, an output section 22 (32) which is extending from the power connection section 21 (31) and passing through the casing 10, and a capacitor connecting section 23 (33) which is extending from an end of the output section 22 (32). In view of the two output sections 22, 32 and the two capacitor connecting sections 23, 33 are only seen when the AC power input socket 100 is viewed from a side, in consequence of the power connection section 21 (31) is disposed in the accommodating groove 111. In addition, each of the conductive pins 20 (30) is provided with a through hole 221 (321) in the output section 22 (32). In one embodiment, each of the through holes 221 (321) is an oval hole. For example, a longitudinal axis width of the through hole 221 (321) is greater than a horizontal axis width of the through hole 221 (321) in the invention.

Figure 2:
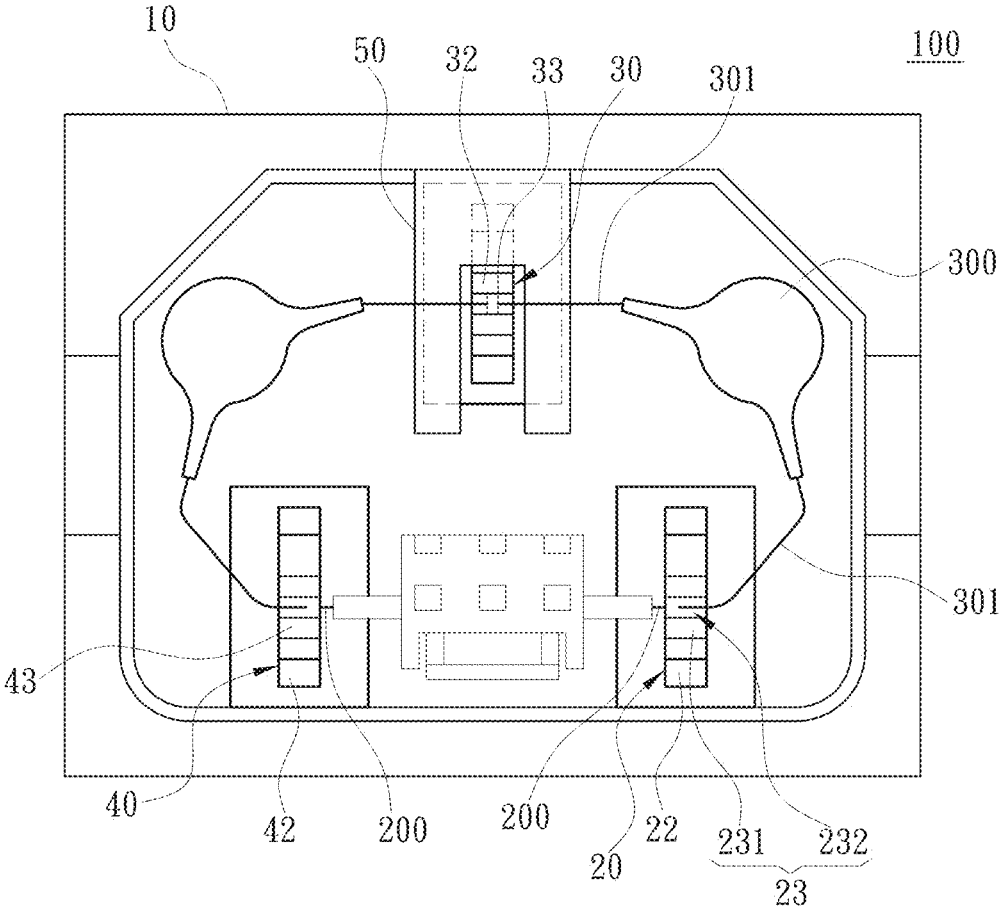
FIG. 2 is a structural top view of connection of a capacitor and an electric wire according to one embodiment of the invention.
Figure 3:
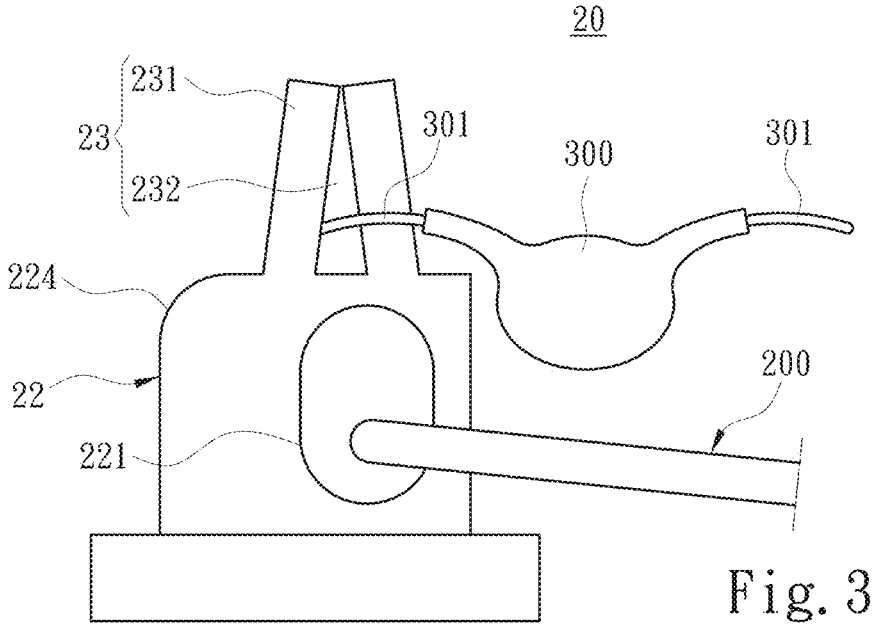
FIG. 3 is an enlarged schematic diagram of a partial structure of a conductive pin connecting to the capacitor and the electric wire according to one embodiment of the invention.
Figure 4:
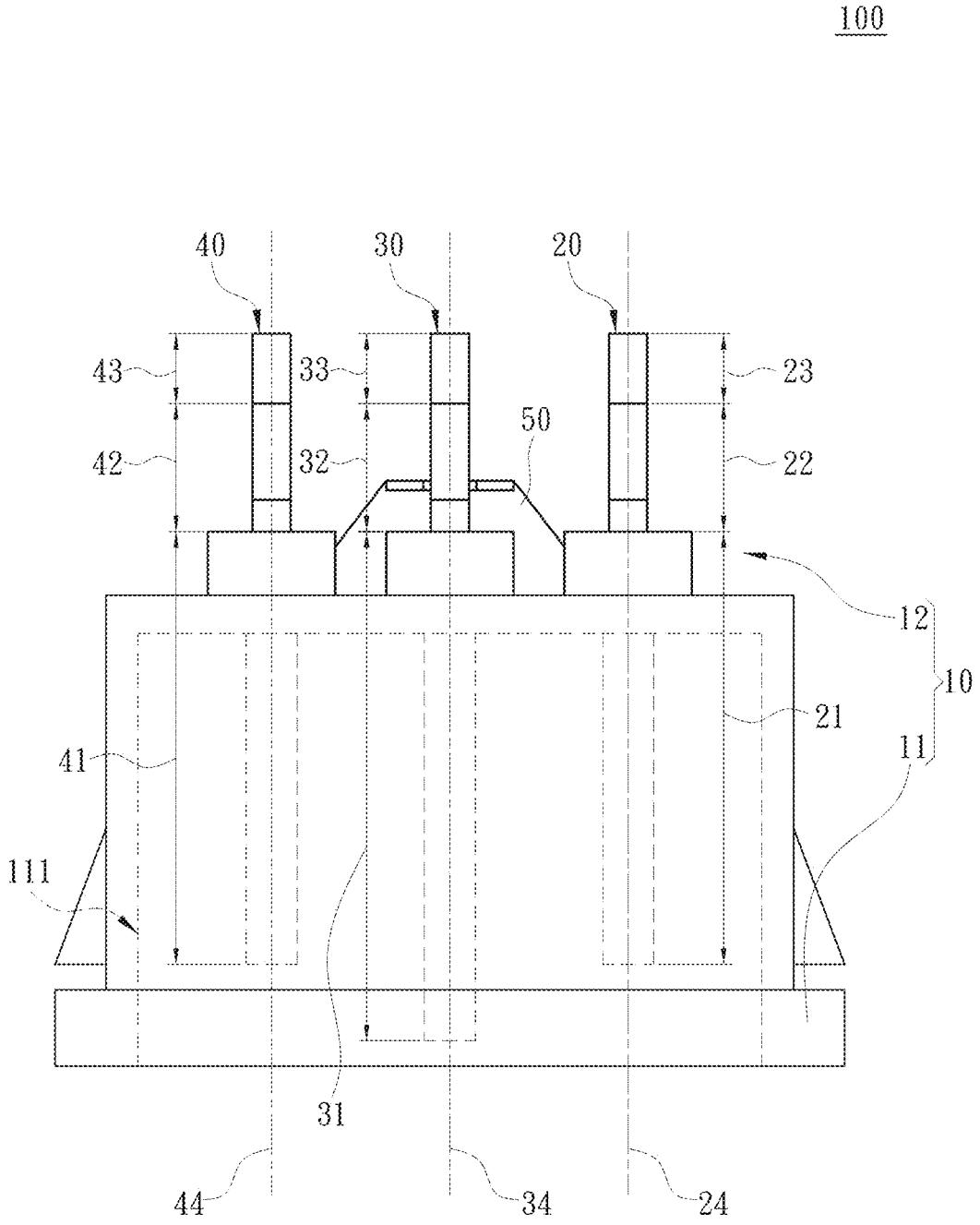
FIG. 4 is a structural plane side view according to one embodiment of the invention.

Please refer to FIG. 2, FIG. 3 and FIG. 4. For the convenience of explaining the two conductive pins 20, 30 in this specification hereinafter, the two conductive pins 20, 30 are respectively defined as the live wire terminal and the ground wire terminal in an order from right to left when viewed from a side of the AC power input socket 100 (as shown in FIG. 4). Then, please refer to FIG. 2 and FIG. 3. The AC power input socket 100 of the invention is connected to an electric wire 200 and a capacitor 300. The capacitor 300 includes two capacitor pins 301. During assembly, the electric wire 200 is connected to the live wire terminal, that is, the electric wire 200 is connected to the conductive pin 20, and the electric wire 200 passes through the through hole 221 of the conductive pin 20. On the other hand, in order to reduce the occurrence of electromagnetic interference, the two capacitor pins 301 are respectively connected to the ground wire terminal and the live wire terminal, that is, the capacitor 300 is connected to the conductive pin 30 and the conductive pin 20. More specifically, one of the two capacitor pins 301 is connected to one of the two capacitor connecting sections 23, and the other of the two capacitor pins 301 is connected to the other of the two capacitor connecting sections 33. Therefore, the electric wire 200 and the two capacitor pins 301 of the invention are respectively assembled at different positions of each of the conductive pins 20. Compared with the prior art, the invention does not need to fix the electric wire 200 and the capacitor 300 at the same time to perform welding so as to facilitate processing by processing personnel. In addition, the invention are capable of reducing the situation that the electric wire 200 and the capacitor 300 are unable to be completely assembled with the conductive pins 20, 30 due to interference of processing positions.

In one embodiment, the AC power input socket 100 further includes three conductive pins 20, 30, 40, two of the three conductive pins 20, 30, 40 are the live wire terminals, and one of the three conductive pins 20, 30, 40 is the ground wire terminal. In this specification, the two conductive pins 20, 40 are implemented as the live wire terminals, and the conductive pin 30 is implemented as the ground wire terminal. Moreover, each of the conductive pins 20 (or 30 or 40) includes a power connection section 21 (or 31 or 41), a output section 22 (or 32 or 42), and a capacitor connecting section 23 (or 33 or 43) respectively, and each of the conductive pins 20 (or 30 or 40) is provided with a through hole 221 (or 321 or 421) in a output section 22 (or 32 or 42).

Please refer to FIG. 2, FIG. 3 and FIG. 4. In this embodiment, the AC power input socket 100 of the invention is connected to two electric wires 200 and two capacitors 300. In order to enable the two electric wires 200 to receive and transmit electric power during assembling, each of the electric wires 200 is connected to one of the two live wire terminals, that is, the two electric wires 200 are connected to the two conductive pins 20, 40 respectively. In addition, each of the electric wires 200 respectively passes through the through hole 221 (or 421) of one of the conductive pins 20 (or 40). In each of the two capacitors 300, the two capacitor pins 301 are respectively connected to the ground wire terminal and one of the live wire terminals. In other words, one of the two capacitors 300 is connected to the conductive pin 30 and the conductive pin 20, and the other of the two capacitors 300 is connected to the conductive pin 30 and the conductive pin 40. More specifically, one of the two capacitors 300 is connected to the two capacitor connecting sections 23, 33, and the other of the two capacitors 300 is connected to the two capacitor connecting sections 33, 43. Each of the two capacitors 300 and each of the two electric wires 200 are located at adjacent positions after being assembled, that is, the two capacitors 300 and the two electric wires 200 do not overlap each other so as to avoid being double connected to the two conductive pins 20 (or 40), and 30.

Figure 5:
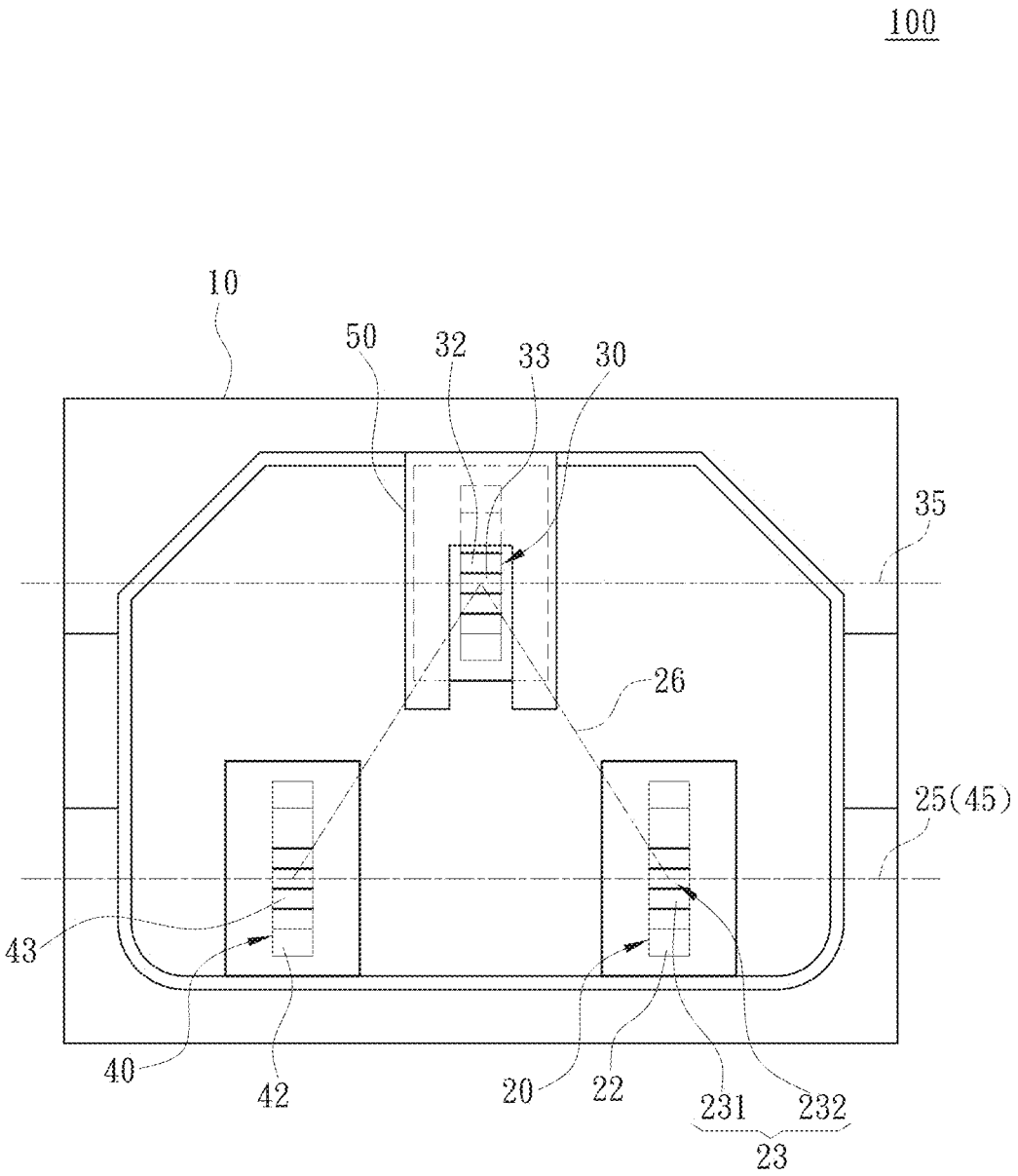
FIG. 5 is a structural plane top view according to one embodiment of the invention.

Furthermore, referring to FIG. 4 and FIG. 5, in one embodiment, the three conductive pins 20, 30, 40 of the invention are respectively disposed at different positions of the AC power input socket 100. Specifically, the three conductive pins 20, 30, 40 respectively include a longitudinal axis extension line 24, 34, 44 and a horizontal axis extension line 25, 35, 45. The three longitudinal axis extension lines 24, 34, 44 of the three conductive pins 20, 30, 40 do not overlap, that is, when viewed from a side of the AC power input socket 100, the three conductive pins 20, 30, 40 are respectively located at different positions of the casing 10, as shown in FIG. 3. In addition, one of the three conductive pins 30 is defined to locate at a base point, and the other conductive pins 20, 40 are respectively located at two sides thereof. The two horizontal axis extension lines 25, 45 of two of the three conductive pins 20, 30, 40 which are located on two sides (such as the two conductive pins 20, 40) overlap, and the horizontal axis extension line 35 of one of the three conductive pins 20, 30, 40 which is located at the middle (such as the conductive pin 30) does not overlap the aforementioned two horizontal axis extension lines 25, 45. In other words, when viewed from a top of the AC power input socket 100, it can be found that the three conductive pins 20, 30, 40 are arranged as a triangle 26, and the three conductive pins 20, 30, 40 are respectively located at apexes of the triangle 26.

Figure 6:
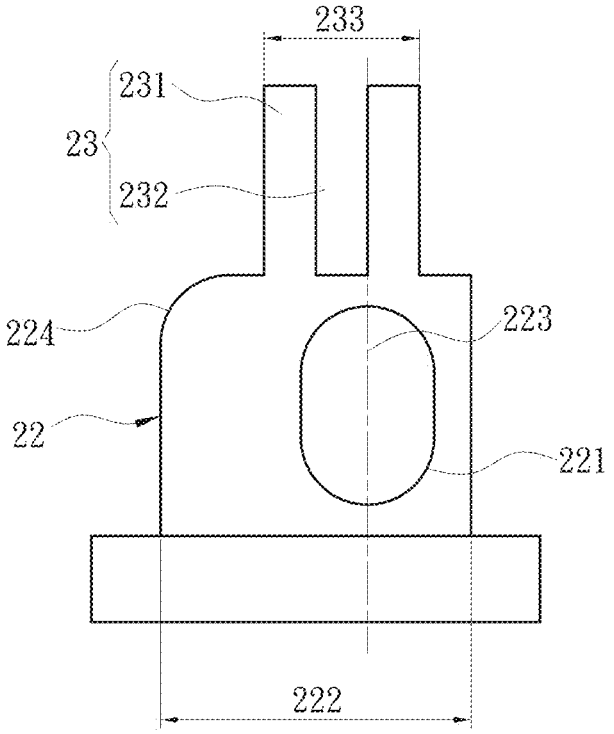
FIG. 6 is an enlarged schematic diagram of a partial structure of the conductive pin according to one embodiment of the invention.

In one embodiment, configurations of the three conductive pins 20, 30, 40 of the invention are the same, and one of the three conductive pins 20 is used for explanation hereinafter in order for the convenience of description. Please refer to FIG. 3 and FIG. 6, the capacitor connecting section 23 is formed by two connecting pins 231 which are respectively connected to the output section 22. The two connecting pins 231 extend from the output section 22 in a direction opposite to the casing 10, and the two connecting pins 231 are parallel and without contacting to each other, that is, the two connecting pins 231 are spaced apart to form a gap 232 therebetween. In addition, during implementation, the gap 232 allows one of the two capacitor pins 301 to pass through thereof. The two connecting pins 231 respectively bear a force to be deformed towards each other, and a position of one of the two capacitor pins 301 is restricted and welded on the two connecting pins 231 being deformed for finalizing the assembly.

The conductive pin 20 of the invention includes a first width 222 at the output section 22, and a second width 233 at the capacitor connecting section 23, wherein the second width 233 is smaller than the first width 222. In other words, a sum of widths of the gap 232 and the two connecting pins 231 is smaller than a width of the output section 22. Furthermore, a sum of the widths of the gap 232 and the two connecting pins 231 is greater or equal to a width of the through hole 221. In one embodiment, the through hole 221 of the invention includes a center line 223, and the gap 232 diverges from the center line 223. On the other hand, in this embodiment, a portion of one side of the output section 22 is a curved surface 224.

Figure 7:
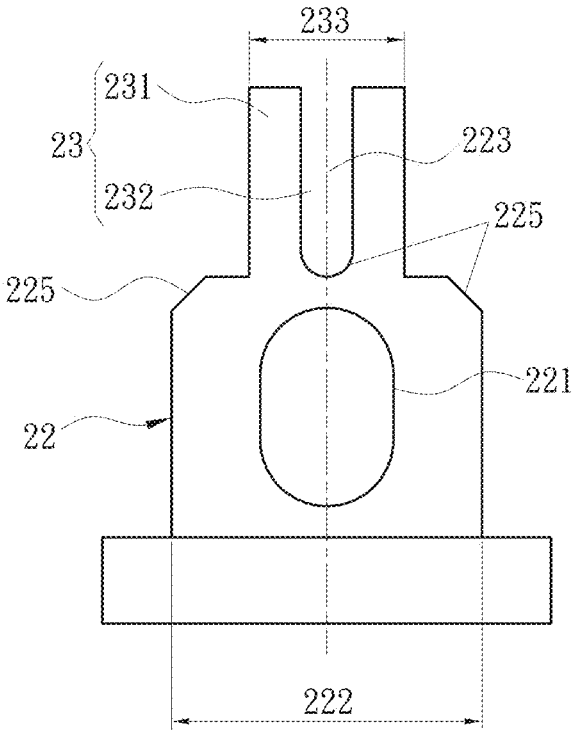
FIG. 7 is an enlarged schematic diagram of a partial structure of the conductive pin according to another embodiment of the invention.

Please refer to FIG. 7. In another embodiment, the conductive pin 20 of the invention can be configured in different shapes. Specifically, the gap 232 of the invention is provided corresponding to the center line 223 of the through hole 221. Moreover, a portion of the output section 22 of the conductive pin 20 which is close to the capacitor connecting section 23 is a slope 225, and the gap 232 is configured as a U-shaped groove.

Furthermore, referring to FIG. 4 and FIG. 5, in one embodiment, the AC power input socket 100 further includes a grounding plate 50 which is disposed around the casing 10 and extends to reach a position of the ground wire terminal (such as one of the three conductive pin 30) defined among the three conductive pins 20, 30, 40. In implementation, the AC power input socket 100 is connected to a ground wire (not shown in the figure). Specifically, the ground wire is connected and welded at the position of one of the three conductive pin 30 and the grounding plate 50, and electric leakage can be reduced in implementation of the AC power input socket 100 through disposal of the grounding plate 50.

What is claimed is:

1. An alternating current (AC) power input socket, comprising:

a casing, defined with a connection side and an output side opposite to the connection side based on performance of the AC power input socket, and the casing provided with an accommodating groove at the connection side for inserting a plug; and three conductive pins, two of the three conductive pins are live wire terminals, one of the three conductive pins is a ground wire terminal, and each of the three conductive pins including a power connection section disposed in the accommodating groove, an output section which is extending from the power connection section and passing through the casing to be exposed on the output side, and a capacitor connecting section which is extending from an end of the output section, and each of the three conductive pins provided with a through hole in the output section for disposing an electric wire, and the capacitor connecting section providing a capacitor pin to be connected thereon;

wherein three longitudinal axis extension lines of the three conductive pins do not overlap, and two horizontal axis extension lines of two of the three conductive pins which are located on two sides overlap, and one horizontal axis extension line of one of the conductive pins which is located in a middle does not overlap with the other two horizontal axis extension lines.

2. The AC power input socket as claimed in claim 1, wherein each of the conductive pins includes a first width at the output section, and each of the conductive pins includes a second width smaller than the first width at the capacitor connecting section.

3. The AC power input socket as claimed in claim 1, wherein the AC power input socket is configured in a power supply unit.

4. The AC power input socket as claimed in claim 1, wherein each of the conductive pins is formed by two connecting pins which are respectively connected to the output section, and the two connecting pins are spaced apart to form a gap therebetween for the capacitor pin to pass through, and the two connecting pins respectively bear a force to be deformed to restrict the capacitor pin in the gap.

5. The AC power input socket as claimed in claim 4, wherein each of the conductive pins includes a first width at the output section, and a sum of widths of the two connecting pins and the gap is smaller than the first width.

6. The AC power input socket as claimed in claim 4, wherein the gap corresponds to a center of the through hole, and a sum of widths of the two connecting pins and the gap is greater than or equal to a width of the through hole.

7. The AC power input socket as claimed in claim 6, wherein a portion of each of the output sections which is close to the capacitor connecting sections is a slope.

8. The AC power input socket as claimed in claim 1, wherein a portion of each of the output sections which is close to the capacitor connecting sections is a slope respectively.

* * * * *